US006663014B1

(12) United States Patent
Depayva et al.

(10) Patent No.: US 6,663,014 B1
(45) Date of Patent: Dec. 16, 2003

(54) METHOD AND SYSTEM OF INTENSIFIER PISTON CONTROL

(75) Inventors: Jeff Depayva, Romeoville, IL (US); Scott Schuricht, Normal, IL (US); Senthil Rajagopalan, Normal, IL (US); Glenn Wells, Minonk, IL (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 10/185,946

(22) Filed: Jun. 28, 2002

(51) Int. Cl.[7] ..... F02M 47/02; F02M 41/16

(52) U.S. Cl. ..... 239/88; 239/95; 239/96; 239/90

(58) Field of Search ..... 239/88, 90, 93, 239/95, 96, 91

(56) References Cited

U.S. PATENT DOCUMENTS 6,024,296 A * 2/2000 Wear et al. ..... 239/88
6,050,497 A * 4/2000 Cotton ..... 239/96
6,113,000 A * 9/2000 Tian ..... 239/88
6,119,960 A * 9/2000 Graves ..... 239/92

* cited by examiner

*Primary Examiner*—Michael J. Hayes
*Assistant Examiner*—Lina R Kontos
(74) *Attorney, Agent, or Firm*—Michael Huber; Steve D Lundquist

(57) ABSTRACT

The movement of the intensifier piston in a fuel injector, to control the pressurization of fuel, can be controlled with a flow control valve. The flow control valve provides different flow rates depending upon the direction of flow. In a first direction, flow control valve has a first rate of flow and in the second direction flow control valve allows a second different rate of flow. Typically, this can be applied to a intensifier piston as follows: flow traveling to the intensifier piston, in the first direction, has a first flow rate, allowing the intensifier to move downward and pressurize fuel. When injection is over, and the intensifier piston is vented, the flow control valve allows a second flow rate which is greater than the first flow rate, allowing the intensifier piston to vent quickly and reset for another injection.

17 Claims, 3 Drawing Sheets

METHOD AND SYSTEM OF INTENSIFIER PISTON CONTROL

TECHNICAL FIELD

The present invention relates to fuel injection and specifically to the ability to control flow rates to and from an intensifier piston and the ability to reset the intensifier piston quickly.

BACKGROUND

Reducing emissions is a top priority for today's engine manufacturers. As the government continues to tighten emission requirements, manufacturers must find new ways to reduce engine emissions while still providing powerful, economic engine operation. One area that engine manufacturers have focused on is fuel injection.

Fuel injection plays a crucial role in the amount of emissions created during combustion. Numerous fuel injection variables, including fuel pressure, spray pattern, droplet size, number of injections and injection timing impact emissions. In order to properly control these parameters, fuel injectors have become more complicated and more precise. For example, one exemplary design of a fuel injector is a hydraulically actuated electronically controlled unit injector such as a Caterpillar HEUT™ B unit injector. This unit injector uses actuation fluid to pressurize fuel for injection. Specifically, a control valve and spool valve control the timing of high pressure actuation fluid acting upon an intensifier piston. When high pressure actuation fluid acts on the intensifier piston, the hydraulic force overcomes a biasing force from a piston spring and moves the piston downward, also moving a plunger, which pressurizes fuel in the pressurization cavity for injection. When injection is over, the control valve allows the high pressure actuation fluid acting on the intensifier piston to vent. This allows a piston spring to push the intensifier piston and plunger back to their original position and reset them for the next injection As emissions regulations have increased, injection strategies have become more complicated. For example, multiple injections, including pilots and posts, reduce emissions during combustion. However, it can be difficult for the Injector to cycle quickly enough to perform multiple injections during a single combustion event. In the hydraulically actuated electronically controlled unit injector described above, multiple injections can be performed by cycling the control valve but depending on the dwell time between injections and the desired injection profile, the intensifier piston may not properly reset between injections.

The present invention is intended to overcome one or more of the above problems.

SUMMARY OF THE INVENTION

A fuel injector comprises a high pressure actuation fluid source, a lower pressure drain, at least one fluid line selectively to one of high pressure actuation fluid source and lower pressure drain, an intensifier piston fluidly connected to the fluid line and a flow control valve. The flow control valve is in fluid communication with the fluid line and the intensifier piston and position to control the rate of flow to and from the intensifier piston. The flow control valve has a first flow rate in the first direction and a second flow rate in a second direction, the second rate being different from the first.

In another embodiment, a fuel injector comprises a high pressure actuation fluid source, a low pressure drain, flow control valve connected with the high pressure actuation fluid source and the low pressure drain and intensifier piston connected to flow control valve. The control flow valve controls the flow rate between the flow control valve and the intensifier piston and has a first flow rate in the first direction and a second flow rate in the second direction.

In another embodiment, a method of controlling intensifier piston comprises pressurizing the intensifier piston at a first flow rate and venting the intensifier piston at a second flow rate, wherein the second flow rate is different than the first flow rate.

In another embodiment of the present invention, a fuel injector comprises a high pressure actuation fluid source, low pressure drain, at least one fluid line selectively connected to one of the high pressure actuation fluid source and low pressure drain, and intensifier piston fluidly connected to the fluid line, and a flow control valve. The flow control is in fluid communication with the fluid line and the intensifier piston and position to control flow to and from the intensifier piston. Further, the flow control valve has a flow in a first direction and a second direction having a flow control valve having a flow restriction for flow in the first direction.

In another embodiment, fuel injector comprises high pressure actuation fluid source, low pressure drain, at least one fluid line, means for selectively connecting the fluid line to one of the high pressure actuation fluid source and low pressure drain, an intensifier piston fluidly connected to the fluid line, and a flow control. The flow control valve is in fluid communication with the fluid line and the intensifier piston and in position to control a rate of flow to and from the intensifier piston. Further, the flow control valve has a first flow rate in the first direction and a second flow rate, different from the first flow rate, in the second direction.

DETAILED DESCRIPTION

Figure 1:
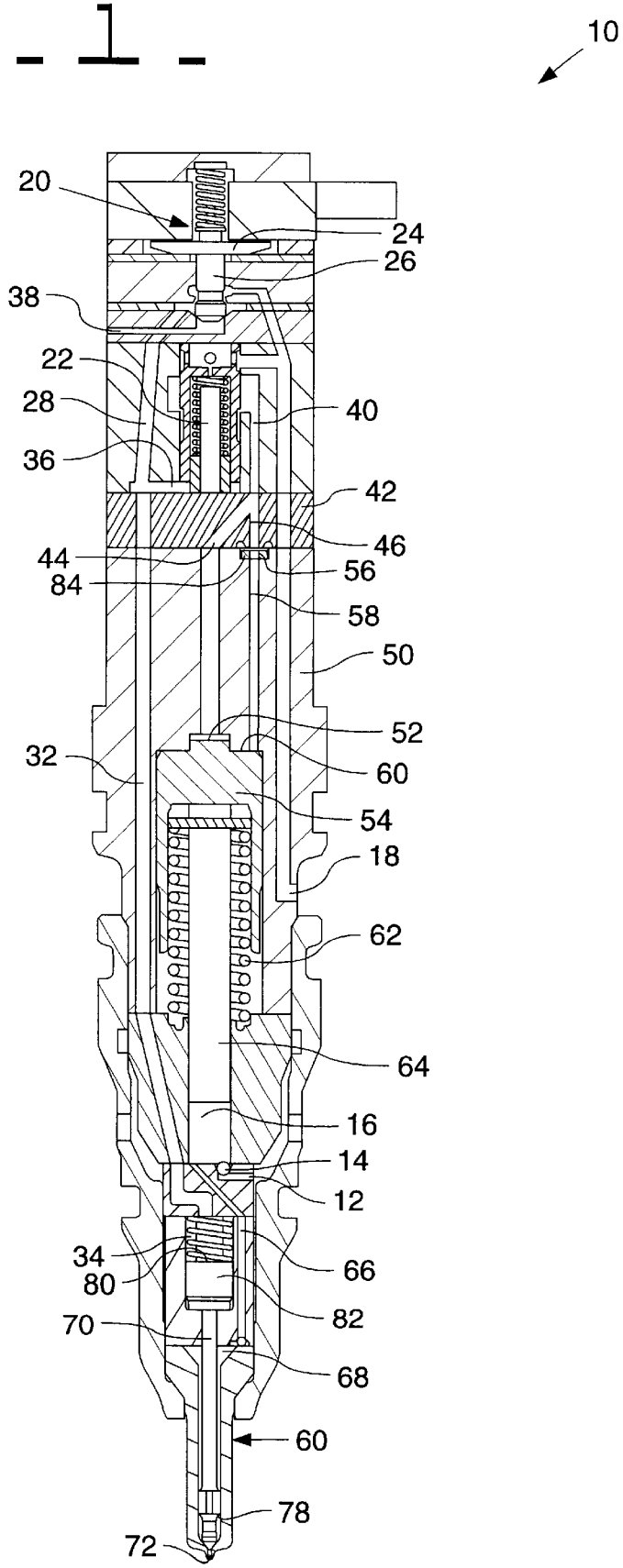
FIG. 1 is a diagrammatic illustration of a cross section of a fuel injector according to one embodiment of the present invention.
Figure 2:
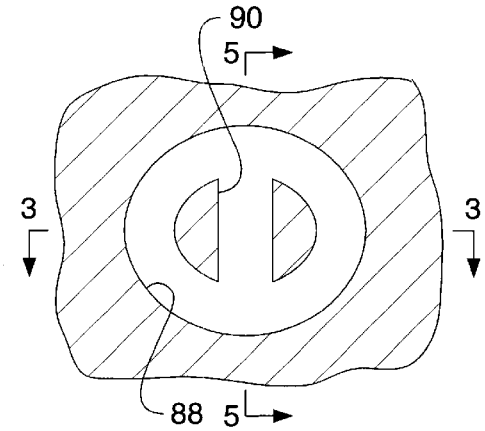
FIG. 2 is a diagrammatic illustration of a bottom view of a damper plate according to the embodiment of FIG. 1.

FIG. 1 is a diagrammatic illustration of a hydraulically actuated electronically controlled unit injector 10. Fuel enters injector 10 through fuel inlet passage 12, passes ball check 14 and enters fuel pressurization chamber 16. High pressure actuation fluid enters injector 10 through actuation fluid inlet passage 18. Actuation fluid then travels to control valve 20 and spool valve 22.

Control valve 20 controls the overall operation of injector 10 and operates as a pilot valve for spool valve 22. Control valve 20 includes an armature 24 and a seated pin 26. A solenoid (not shown) in control valve 20 controls movement of armature 24 and therefore the position of the seated pin 26. In a first position, seated pin 26 allows high pressure actuation fluid to travel through upper check passage 28 and lower check passage 32 to check control cavity 34. When seated pin 26 is in the first position, high pressure actuation fluid also travels through upper check passage 28 to spool passage 36 to balance spool valve 22 in its first position. When seated pin 26 is in its second position, high pressure actuation fluid from actuation fluid inlet passage is blocked and upper check passage 28, lower check passage 32, check control cavity 34 and spool passage 36 are open to low pressure drain 38.

When seated pin 26 is moved to its second position, the spool passage 36 is open to low pressure drain 38, which unbalances spool valve 22 and allows high pressure actuation fluid to travel through upper intensifier passage 40, into damper plate 42 where the flow is split in to two passages; middle intensifier passage 44 and upper rate shaping passage 46. High pressure actuation fluid in middle intensifier passage 44 proceeds to lower intensifier passage 48, in central body 50 where it acts upon piston hat 52 of intensifier piston 54. Flow also travels from upper rate shaping passage 46 through flow control valve 56 to lower rate shaping passage 58 where the high pressure actuation fluid acts on the shoulder 60 of intensifier piston 54.

When high pressure actuation fluid acts upon intensifier piston 54, intensifier piston 54 moves downward, against the force of piston spring 62, causing plunger 64 to move downward and pressurize fuel in fuel pressurization chamber 16. Fuel in fuel pressurization chamber 16 is pressurized to injection pressure and is directed through high pressure fuel passage 66 and into fuel cavity 68.

Check 70 is located in the nozzle assembly of injector 10 and controls the flow of fuel through orifices 72, in nozzle tip 74, into the combustion chamber (not shown). Check 70 is biased in the closed position by check spring 76. High pressure fuel in fuel cavity 68 acts on an opening surface 78 of check 70 and pushes it upwards, against check spring 76, into the open position, allowing injection through orifice 72. Check opening and closing is also hydraulically controlled by check control cavity 34. When high pressure actuation fluid is present in check control cavity 34, it helps keep check 70 closed even when high pressure fuel is present in fuel cavity 68. High pressure actuation fluid acts upon a closing surface 80 of check piston 82 and hydraulically offsets and, in fact overcomes, the pressure from the high pressure fuel in fuel cavity 68. The high pressure actuation fluid helps close check 70 in combination with check spring 76. Injection occurs when check control cavity 34 is opened to low pressure drain 38, leaving the pressurized fuel to overcome only the check spring's 76 force. By controlling the high pressure actuation fluid in check control cavity 34, injection timing and duration can be more accurately controlled.

When injection is finished, seated pin 26 is returned to its first position, allowing high pressure actuation fluid into check control cavity 34 and spool passage 36. As stated above, high pressure actuation fluid in check control cavity 34 closes check 70. Further, high pressure actuation fluid in spool passage 36 causes spool valve 22 to return to its original position, stopping the flow of high pressure actuation fluid to the intensifier piston 54 and allowing the high pressure actuation fluid acting on the intensifier piston 54 from upper, middle, and lower intensifier passages 40, 44, 48 and upper and lower rate shaping passages 46, 58 to drain, allowing intensifier piston 54 and plunger 64 to return to their original positions.

Figure 3:
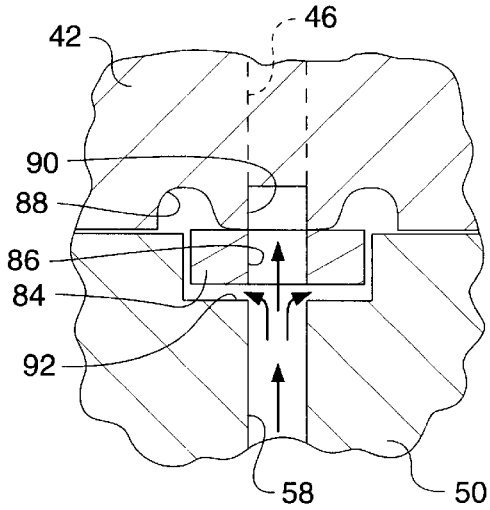
FIG. 3 is a diagrammatic illustration of a cross section of a flow control valve along line 3—3 of the embodiment illustrated in FIG. 1.
Figure 4:
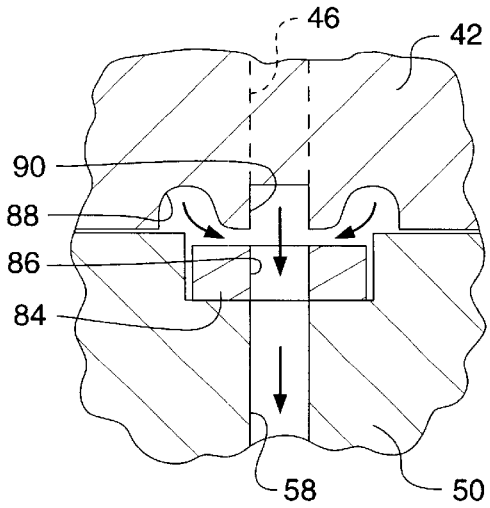
FIG. 4 is a diagrammatic illustration of a cross section of a flow control valve along line 3—3 of the embodiment illustrated in FIG. 1.
Figure 5:
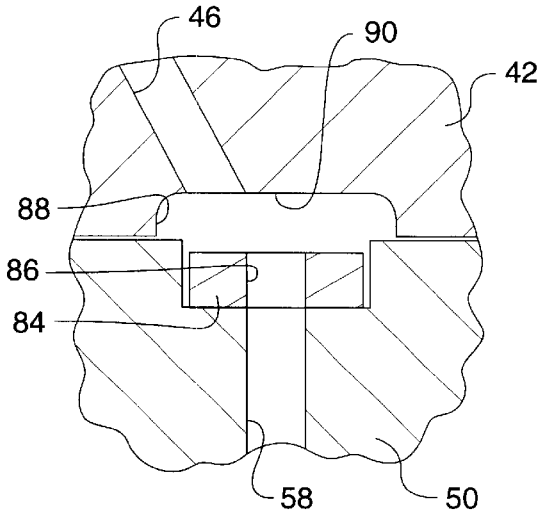
FIG. 5 is a diagrammatic illustration of a cross section of a flow control valve along line 5—5 of the embodiment illustrated in FIG. 1.

Flow control valve 56 controls the rate of flow through upper and lower rate shaping passages 46, 58. FIGS. 2–5 are enlarged diagrammatic cross sections of flow control valve 56 illustrated in FIG. 1. In this embodiment, flow control valve 56 includes rate shaping orifice plate 84 and grooved damper plate 42. Rate shaping orifice plate 84 is a circular disk that defines rate shaping orifice 86 through the center of plate 84. Damper plate 42 defines a circular annulus 88 and a center passage 90 that is in fluid communication with circular annulus 88. When high pressure fluid is moving from upper rate shaping passage 46 to lower rate shaping passage 58, as illustrated in FIG. 4, rate shaping orifice plate 84 is pushed down, forming a seal with central body 50 and only allowing flow through rate shaping orifice 86. When fluid is moving from lower rate shaping passage 58 to upper rate shaping passage 46, as illustrated in FIG. 3, rate shaping orifice plate 84 is moved up, away from central body 50, allowing flow through rate shaping orifice 86 and around rate shaping orifice plate 84 in annular plate passage 91. This allows for a higher flow rate. As illustrated in this embodiment, flow control valve 56 results in a first flow rate to pressurize intensifier piston 54 and a faster flow rate for venting the fluid acting on intensifier piston 54.

Figure 6:
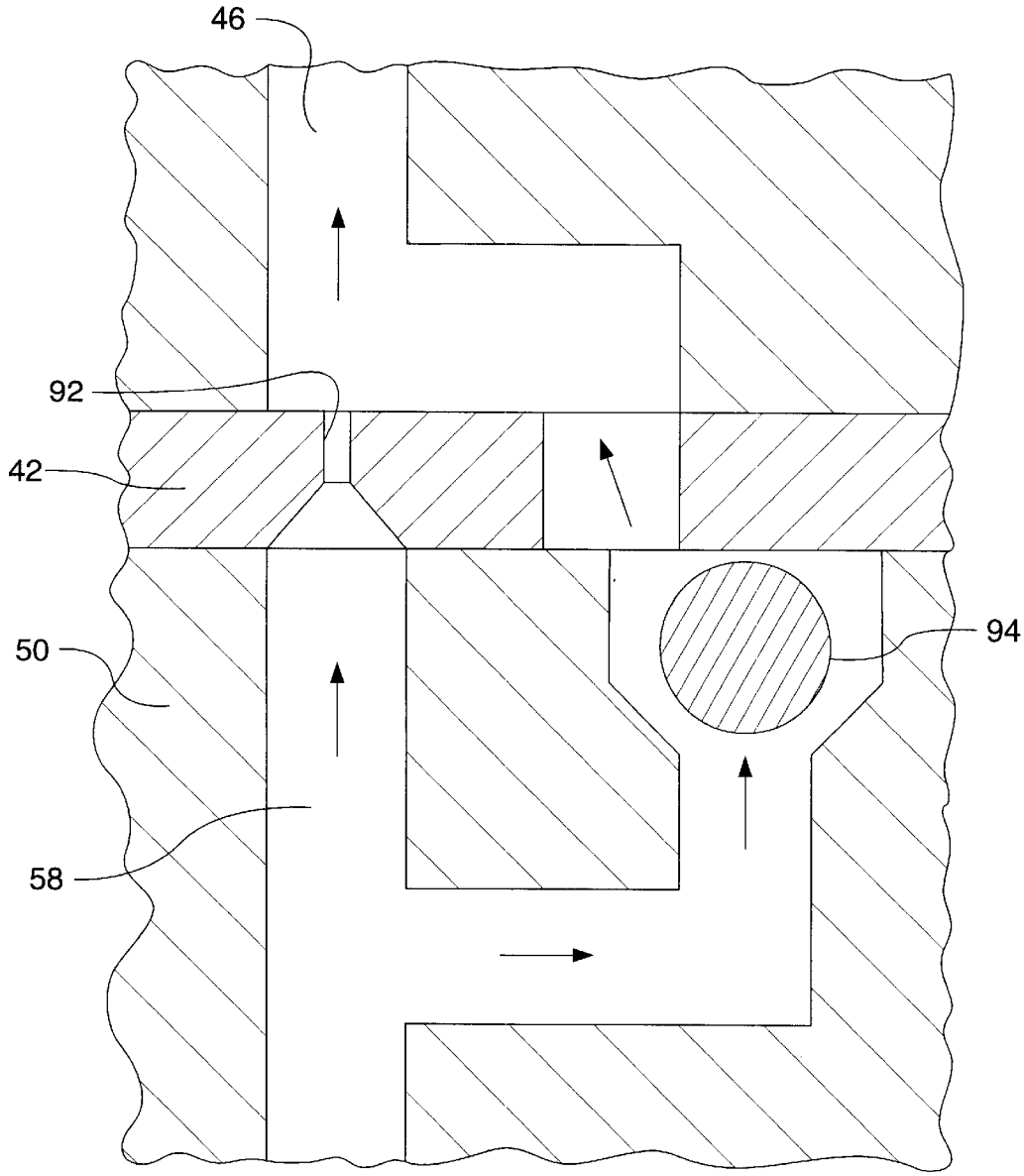
FIG. 6 is an enlarged diagrammatic illustration of a cross section of a flow control valve according to another embodiment of the present invention.

Alternative flow control valve configurations can be implemented. Flow control valve 56 must simply allow different flow rates depending on the direction of the flow. FIG. 6 illustrates an alternative embodiment for flow control valve 56. Thins embodiment comprises a flow orifice 92, located in damper plate 42, and a flow ball check 94 located in central body 50. When flow is moving in the first direction, from upper rate shaping passage 46 to lower rate shaping passage 58, actuation fluid travels through flow orifice 92 but flow ball check 94 is closed. This results in a slower flow rate and less pressure on shoulder 60. When flow is moving in the second direction, from lower rate shaping passage 58 to upper rate shaping passage 46, venting the cavity acting on shoulder 60, flow travels through flow orifice 92 and also through flow ball check 94, due to the ball coming of its seat. This allows a faster venting flow rate than filling flow rate.

Industrial Applicability

Controlling injection pressure and timing is important to reducing emissions. Further, multiple injections per engine cycle, such as pilots and posts, can also have a significant impact in emissions controls. Multiple injections could include two injections per cycle or as many as five or more. As the number of injections increase, injector speed must also increase. Unfortunately, many current injectors may have a difficult time cycling or resetting fast enough to allow multiple injections per engine cycle. For example, depending on the timing of the injection events and the desired quantity per event, an intensifier piston, used to pressurize fuel for injection, may not be able to reset quickly enough to perform all necessary injections.

Flow control valve 56 allows different flow rates to and from the intensifier piston 54. For example, flow control valve 56 allows a first flow rate to intensifier piston 54 to pressurize fuel at a desired rate (Note that this rate can adjusted and tuned by those skilled in the art by including rate shaping features, such as piston hats and rate shaping orifices.) Flow control valve 56 allows a second, faster flow rate away from intensifier piston 54 when the actuation passages are open to drain. This allows for quicker venting, allowing intensifier piston 54 to reset quicker. This allows the intensifier to handle multiple injection in the same engine cycle.

As explained above, injector 10 starts in a closed or no-injection state. Control valve 20 is in its first position providing high pressure actuation fluid to the check control cavity 34. This insures that check 70 remains closed, preventing any fuel from entering the combustion chamber (not shown) through orifice 72. Control valve 20 also provides high pressure actuation fluid to spool passage 36, thereby biasing spool valve 22 in its first position, which prevents high pressure actuation fluid from acting on intensifier piston 54 and pressurizing fuel.

When injection is desired, control valve 20 is actuated causing seated pin 26 to move to its second position. This opens spool passage 36 to low pressure drain 38, allowing spool valve 22 to move to its second position. In its second position, spool valve 22 allows high pressure actuation fluid to act upon intensifier piston 54, which causes intensifier piston 54 and subsequently plunger 64 to move downward and pressurize fuel in fuel pressurization chamber 16. Specifically, high pressure actuation fluid travels through upper, middle and lower intensifier passages 40, 44, and 48 to act upon the piston hat 52. High pressure actuation fluid also travels through upper rate shaping passage 46, flow control valve 56 and lower rate shaping passage 58 to act upon shoulder 60. As the high pressure actuation fluid travels through flow control valve 56, rate shape orifice plate 84 is pushed downward, forming a seal with central body 50. This allows flow to only travel through rate shaping orifice 86.

The high pressure actuation fluid acting on hat 52 and shoulder 60 causes intensifier piston 54 to move downward, moving plunger 64, and pressurize fuel at the desired rate. (Note the rate of pressurization can change if and when the piston hat 52 comes out of the bore.) Pressurized fuel from pressurization chamber 16 then moves to fuel cavity 68 where it acts on check 70, trying to push check 70 up, into the open position, so that injection can occur. When seated pin 26 is in the second position, check control cavity 34 is also opened to low pressure drain 38. This results in check spring 76 being the only thing that keeps check 70 closed; however, as fuel is pressurized, the force of pressurized fuel overcomes the force of the check spring 76 and moves check 70 to its open position.

When end of injection is desired, control valve 20 is de-actuated and seated pin 26 is moved back to its first position. This results in high pressure actuation fluid traveling back in to spool passage 36 to bias spool valve 22 in its first position. Moving back to its first position, spool valve 22 blocks the high pressure actuation fluid and opens upper, middle and lower intensifier passages 40, 44, 48 to drain. Lower rate shaping passage 58 and upper rate shaping passage 46 are also opened to drain. As actuation fluid travels in this direction, back through flow control valve 56, the flow rate is increased. Rate shape orifice plate 84 moves off of central body 50 allowing flow through rate shaping orifice 86 and around plate 84 in the annular plate passage 91. By venting the high pressure actuation fluid acting on intensifier piston 54, piston spring 62 can reset intensifier piston 54 back in its original, up position.

Additionally, when the seated pin 26 moves back to its first position, high pressure actuation fluid is again directed through upper and lower check passages 28, 32 and back into check control cavity 34 to insure check closure.

It should be noted that the valve arrangement in the injector shown provides a fast moving control valve 20 and a slow moving spool valve 22. This can impact the rate shaping capabilities of the injector 10. For example, it may be possible to cycle control valve 20 quickly enough to stop and start injection without spool valve 22 ever really changing positions. In this scenario, flow control valve 56 does not play much of a role, instead it just acts as a conventional rate shaping orifice. However, when multiple injections are sufficiently spaced apart, such that spool valve 22 has time to react, flow control valve 56 allows intensifier piston 54 to reset quickly.

As illustrated above, flow control valve 56 could have alternative embodiments. Further, depending on the embodiment, more or less body parts could be used. For example, the flow control valve embodiment shown in FIG. 6 could be implemented in one piece. Further, the size of the valve and its passages and orifices can be sized according to each injector's specific design. Those skilled in the art will understand that modeling and experimentation on valve and orifice sizes will achieve desired results.

The present example has only illustrated a single injection event but multiple injections per engine cycle could be employed. Further, actuation fluid is preferably lubrication oil but could be any variety of other engine fluids, including fuel, coolant, or steering fluid.

The present example also illustrates the use of the flow control valve in a hydraulically actuated electronically controlled unit injector; however, the flow control valve could be used in a variety of other injector types, including common rail systems, or other hydraulic devices.

Other aspects, features, and advantages of the present invention may be obtained from a study of this disclosure and the drawings, along with the appended claims.

What is claimed is:

1. A fuel injector comprising:

a high pressure actuation fluid source;

a low pressure drain;

at least one fluid line selectively connected to one of said high pressure actuation fluid source and said low pressure drain;

an intensifier piston fluidly connected to said fluid line;

a flow control valve in fluid communication with said fluid line and said intensifier piston and positioned to control a rate of flow to and from said intensifier piston; and said flow control valve having a first flow rate in a first direction and a second rate, different from said first rate in a second direction.

2. The fuel injector of claim 1 further including:

a control valve to selectively connect said fluid line to one of said high pressure actuation fluid source and said low pressure drain.

3. The fuel injector of claim 1 wherein said control valve and said flow control valve are a single valve.

4. The fuel injector of claim 1 wherein:

said first direction includes flow from said high pressure source to said intensifier piston; and said second direction includes flow from said intensifier piston to said low pressure drain.

5. The fuel injector of claim 4 wherein:

said first flow rate is less than said second flow rate.

6. The fuel injector of claim 1 wherein said flow control valve is passively operated.

7. The fuel injector of claim 1 wherein said flow control valve includes a rate shape orifice plate.

8. The fuel injector of claim 1 wherein said flow control valve includes a flow orifice and a flow ball check.

9. A fuel injector comprising:

a high pressure actuation fluid source;

a low pressure drain;

a flow control valve connected with said high pressure actuation fluid source and said low pressure drain;

an intensifier piston connected to said flow control valve;

said flow control valve controlling the flow rate between said flow control valve and said intensifier piston and having a first flow rate in a first direction and a second flow rate, different from said first flow rate, in a second direction.

10. The fuel injector of claim 9 further including:

a control valve connected to said high pressure actuation fluid source and said low pressure drain; and said control valve selectively connecting said flow control valve to one of said high pressure actuation fluid source and said low pressure drain.

11. The fuel injector of claim 9 wherein:

said first direction includes flow from said flow control valve to said intensifier piston; and said second direction includes flow from said intensifier piston to said flow control valve.

12. The fuel injector of claim 11 wherein:

said first flow rate is less than said second flow rate.

13. The fuel injector of claim 9 wherein said flow control valve is passively operated.

14. The fuel injector of claim 9 wherein said flow control valve includes a rate shape orifice plate.

15. The fuel injector of claim 9 wherein said flow control valve includes a flow orifice and a flow ball check.

16. A fuel injector comprising:

a high pressure actuation fluid source;

a low pressure drain;

at least one fluid line selectively connected to one of said high pressure actuation fluid source and said low pressure drain;

an intensifier piston fluidly connected to said fluid line;

a flow control valve in fluid communication with said fluid line and said intensifier piston and positioned to control flow to and from said intensifier piston; and said flow control valve having a flow in a first direction and a second direction and said flow control valve having a flow restriction for said flow in said first direction.

17. A fuel injector comprising:

a high pressure actuation fluid source;

a low pressure drain;

at least one fluid line;

means for selectively connecting said fluid line to one of said high pressure actuation fluid source and said low pressure drain;

an intensifier piston fluidly connected to said fluid line;

a flow control valve in fluid communication with said fluid line and said intensifier piston and positioned to control a rate of flow to and from said intensifier piston; and said flow control valve having a first flow rate in a first direction and a second rate, different from said first rate in a second direction.

* * * * *